US006521850B2

(12) United States Patent
Bertani

(10) Patent No.: US 6,521,850 B2
(45) Date of Patent: Feb. 18, 2003

(54) APPARATUS FOR DELIVERING HOT AIR

(75) Inventor: Carlo Bertani, Montechiarugolo (IT)

(73) Assignee: Mo-El Reggio Emilia (IT)

( * ) Notice: Subject to any disclaimer, the term of this patent is extended or adjusted under 35 U.S.C. 154(b) by 0 days.

(21) Appl. No.: 09/897,648

(22) Filed: Jun. 29, 2001

(65) Prior Publication Data

US 2002/0003953 A1 Jan. 10, 2002

(30) Foreign Application Priority Data

Jul. 10, 2000 (EP) ..... 00830482

(51) Int. Cl.[7] ..... H01H 35/00
(52) U.S. Cl. ..... 200/61.6; 200/52 R
(58) Field of Search ..... 200/52 R, 61.6, 200/61.45, 325; 219/369, 222, 201, 202; 34/97, 96

(56) References Cited

U.S. PATENT DOCUMENTS 4,314,120 A * 2/1982 Sharp et al. ..... 200/61.48
4,937,432 A 6/1990 Bertani
5,269,071 A 12/1993 Hamabe et al.

FOREIGN PATENT DOCUMENTS

FR 2 607 684 10/1988

OTHER PUBLICATIONS

Patent Abstracts of Japan, Kyushu Hitachi Maxell Ltd., 06046921 (Feb. 1994).
European Search Report (Dec. 13, 2000).

* cited by examiner

*Primary Examiner*—Elvin Enad
*Assistant Examiner*—M. Fishman
(74) *Attorney, Agent, or Firm*—Robert F I Conte; Lee Mann Smith McWilliams Sweeney & Ohlson

(57) ABSTRACT

An apparatus (1) for delivering hot air comprises a protection structure (2) to be fastened to a wall (4) and a delivery unit (9) set to generate a continuous air flow. The delivery unit (9) is in engagement with the protection structure (2) through a ball joint (12, 13) so that it is movable between a rest position and an infinite number of operating positions. Associated with the bail joint (12, 13) is an electric switch which is switched over to a closed condition when the delivery unit (9) reaches one of its operating positions thereby starting said delivery unit (9).

14 Claims, 2 Drawing Sheets

APPARATUS FOR DELIVERING HOT AIR

FIELD AND BACKGROUND OF THE INVENTION

The present invention relates to an apparatus for delivering hot air comprising a protection structure to be fastened to a support structure; at least one air-delivery unit oscillatably linked to the protection structure and movable between a rest position in which air delivery is shut off and an operating position at which air deliver is started; at least one electric control device operatively associated with the delivery unit to start and/or shut off said unit at said operating position and rest position respectively.

In more detail, the apparatus of the invention is particularly used as hair-drier in private houses for habitation or in changing rooms and public facilities such as gymnasiums, swimming-pools, hotels or others.

It is known that apparatuses of the above mentioned type comprise a protection structure to be fastened to a wall by appropriate screw-threaded elements and an air-delivery unit disposed within the protection structure. The protection structure keeps the delivery unit and the components associated therewith safe from humidity and possible water splashes.

Such an apparatus is described in U.S. Pat. No. 4,937,432 in the name of the same Applicant.

In detail, the air-delivery unit comprises a substantially tube-shape case hinged or slidably guided on the protection structure and provided with an air-inlet end and an air-outlet end. Operatively disposed within the case is a fan o be operated by an electric motor to cause an air flow moving from the inlet end to the outlet end. One or more electrical resistances for heating the moving air flow are put within the case so as to cause heating of the outgoing air.

In addition, a delivery tube extends from the outlet end of the case and it leads the outgoing air to a delivery opening which is handled by a user to direct the hot air blow in the desired orientation.

Since the delivery case is rotatably hinged or slidably guided with respect to the protection structure, it can oscillate between a rest position in which air delivery is shut off and an operating position in which air delivery is started.

Also associated with the delivery unit is a normally-open electric switch which is switched over to a closed position when the delivery tube is pulled by the user and the case is consequently shifted from the rest position to tie open position. Air delivery therefore starts and goes on until the delivery unit is put back to its initial position, i.e. its rest position.

The Applicant has found that known apparatuses are not free of some drawbacks and can be improved from different points of view mainly in connection with the air-delivery starting system. In fact, in order to move the delivery unit and obtain starting of same, it is necessary to pull the delivery tube in a predetermined direction. As a matter of fact, tire operating position can only be reached through a rotation of the case around a predetermined winging axis or displacement of the case in a predetermined direction. More specifically, the starting system of the delivery unit does not allow the user to start air delivery at any position. For instance, if the tube is palled in a direction parallel to the hinging rotation axis, the delivery unit does not move from the rest position to the operating position and consequently air delivery is not started.

SUMMARY OF THE INVENTION

It is an object of the present invention to solve the problems found in the known art by proposing an apparatus for delivering hot air ensuring air delivery at any position taken by the user.

The foregoing and further objects, that will become more apparent in the course of the following description are substantially achieved by an apparatus for delivering hot air further comprising coupling means (11) operatively interposed between the delivery unit (9) and the protection structure (2) to oscillatably engage the delivery unit around at least first and second rotation axes ("Y", "Z") which are perpendicular to each other.

BRIEF DESCRIPTION OF THE DRAWINGS

Further features and advantages will be best understood from he detailed description of a preferred but not exclusive embodiment of an apparatus for delivering hot air in accordance with the present invention, given hereinafter, by way of non-limiting example, with reference to the accompanying drawings, in which.

DESCRIPTION OF THE PREFERRED EMBODIMENT

Figure 1:
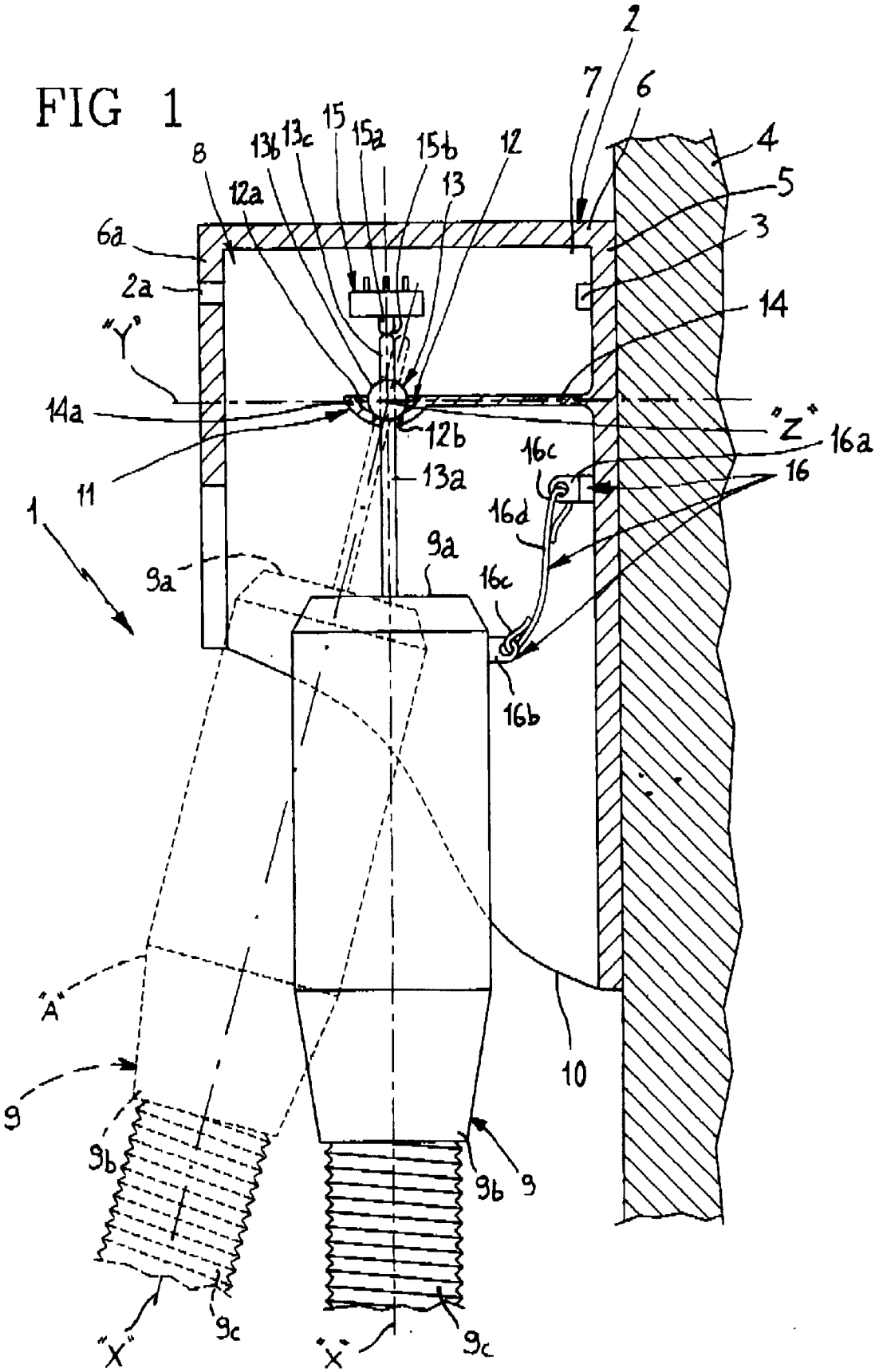
FIG. 1 shows an apparatus for delivering hot air in accordance with the present invention seen partly in longitudinal section.
Figure 2:
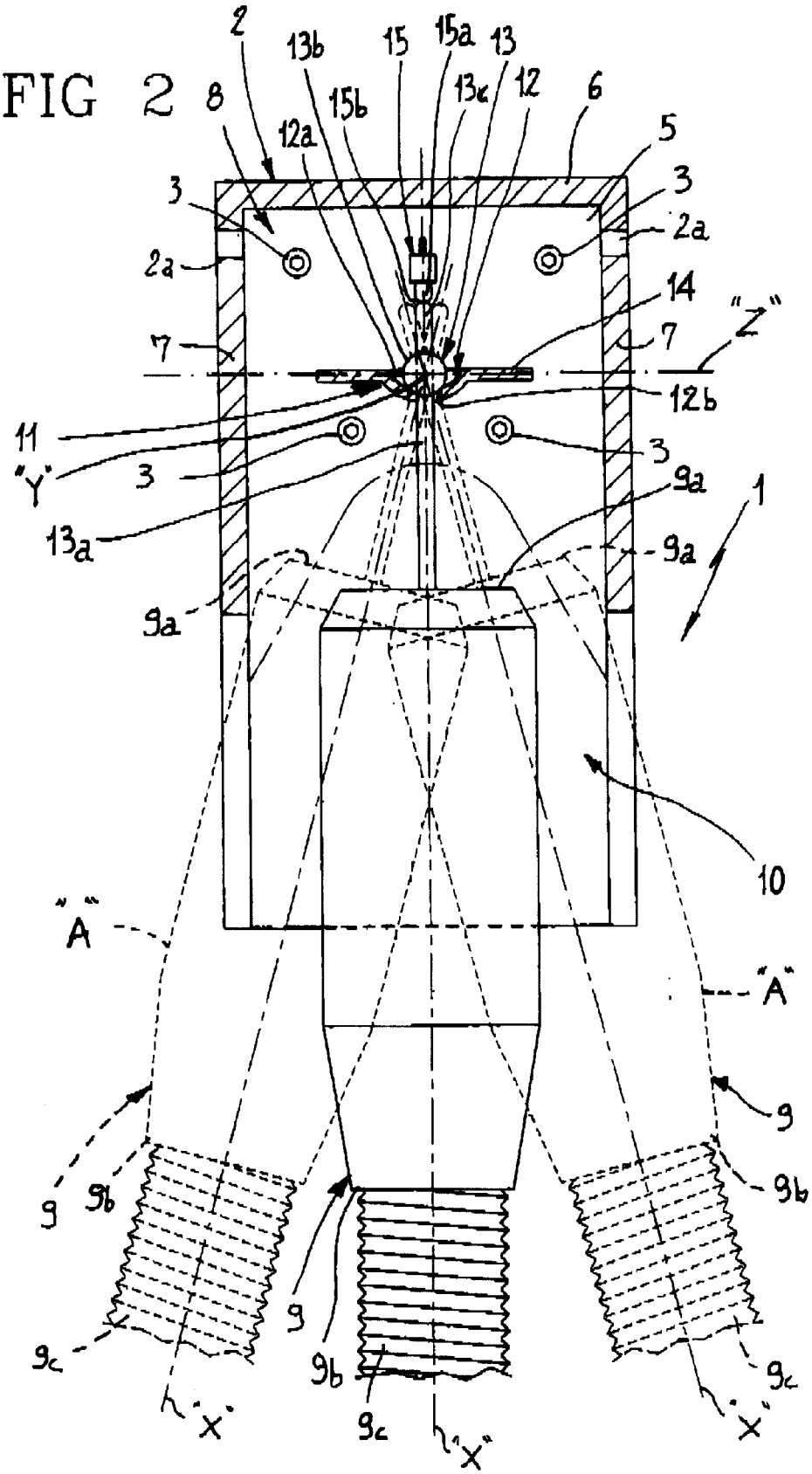
FIG. 2 shows the apparatus referred to in FIG. 1 seen partly in cross-section.

With reference to the drawings, an apparatus for delivering hot air in accordance with the invention has been generally identified by reference numeral 1.

As viewed from the accompanying drawings, apparatus 1 comprises a protection structure 2 to be fastened through screw-threaded elements 3 for example, to a wall 4 of a room to use as a toilet or bathroom, or to any other support structure adapted to carry apparatus 1 at a position accessible to a user. In detail, the protection structure 2 has a fastening wall 5 adapted to be engaged by the threaded elements 3, an upper wall 6 rigid, along a peripheral edge thereof, with the fastening wall 5 and side walls 7 integrally secured to the fastening wall 5 and the upper wall 6.

The upper wall 6 has a protection portion 6*a* jutting out downwardly so as to define, together with the fastening wall 5 and side walls 7, a covering hollow space 8 for the air-delivery unit 9. More specifically, the delivery unit 9 is partly disposed within the covering hollow space 8 and extends outwardly thereof through an access opening 10 placed below the protection structure 2.

The delivery unit 9 encloses a motor inside it, which motor (not shown as it is known) is electrically connected to a power circuit and mechanically connected to a fan to generate therewith an air flow from an inlet end 9*a* to an outlet end 9*b*. The delivery unit 9 further comprises one or more electric resistances adapted to heat the air flow.

In addition, extending downwardly from the outlet end 9*b* is a flexible delivery tube 9*c* terminating with a delivery opening or mouth the orientation of which can be manually adjusted by the user depending on requirements.

The delivery unit 9 is rotatably linked to the protection structure 2 and is movable between a rest position at which air delivery is shut off and an operating position at which air delivery is started.

With reference to the accompanying figure, when the delivery unit 9 is at a rest position a longitudinal axis "X"

thereof is disposed substantially vertically whereas when the delivery unit 9 is at an operating position, as shown in chain line at "A", the longitudinal axis "X" is inclined to a vertical direction.

More specifically, mobility of the delivery unit 9 is ensured by the presence of coupling means 11 operatively interposed between the delivery unit 9 and the protection structure 2. This coupling means 11 enables the delivery unit 9 to oscillate about at least one first rotation axis "Y" and one second rotation axis "Z" substantially perpendicular to each other and lying in one and the same reference plane, which is For instance substantially horizontal.

In more detail, the coupling means 11 essentially involves use of a ball joint comprising at least one holding seating 12 formed in the protection structure 2 and having a concave and substantially curved active surface 12*a*. Preferably, the active surface 12*a* of the holding seating 12 is shaped like a ball-shaped region.

More particularly, the holding seating 12 is formed in an end 14*a* of a shelf-shaped portion 14 projecting in cantilevered fashion at the inside of the protection, structure 2 and standing above the delivery unit 9.

The coupling means 11 further comprises an engagement element 13 associated with the delivery unit 9 through a substantially elongated connecting portion 13*a* passing through a through opening 12*b* formed in a central region of the holding seating 12. Such an engagement element 13 also has a substantially rounded active portion 23*b*, preferably shaped in the form of a ball, cooperating with the active surface 12*a* of the holding seating 12 to ensure freedom of oscillation to the delivery unit 9 around infinite axes of rotation passing through a common point identified with the rotation center of the active portion 13*b* on the holding seating 12. The active portion 13*b* is of one piece construction with the connecting portion 13*a* and the holding seating 12 is interposed between the active portion 13*b* and the delivery unit 9.

Extending on the opposite side with respect to the connecting portion 13*a* is a lug 13*c* interacting with a control device 15 associated with a power circuit and consisting of a switch for example, which is placed within the covering hollow space 8, to start and/or shut off air delivery. In more detail, the lug 13*c* is set to act on a contact element 15*a* extending from the control device 15 in the direction of the engagement element 13*b*. The contact element 15*a* is movable between an inserted position in which the power circuit is open and is not passed through by electric current and a drawn-out position in which the power circuit is closed and the electric current can flow therethrough and supply the delivery unit 9. Further associated with the contact element 15*a* is spring return means (not shown as it is known) tending to keep the contact element 15 to a drawn-out position. When the delivery unit 9 is in a rest position, the lug 13*c* exerts pressure against the contact element 15*a* keeping it to an inserted position. When the delivery unit 9 is in an operating position, the lug 13*c* is disengaged from the contact element 15*a* which is maintained in a drawn-out position by the spring return means.

To facilitate the pressure action exerted by lug 13*c* on the contact element 15*a* during transition of the delivery unit 9 from the operating position to the rest position, the contact element 15*a* has a substantially rounded and preferably spherical end 15*b*.

Apparatus 1 further comprises locking means 16 operatively interposed between the protection structure 2 and the delivery unit 9.to inhibit possible rotations of the delivery unit 9 around its own longitudinal axis "X".

In detail, the locking means 16 comprises a hooking element 16*a* extending within the covering hollow space 8 from the fastening wall 5 and an auxiliary hooking element 16*b* extending sideways from the delivery unit 9. The hooking element 16*a* and auxiliary hooking element 16*b* are engaged, each at a respective through hole for example, by corresponding ends 16*c* of a rigid or flexible connecting element 16*d* interposed between the delivery unit 9 and the fastening wall 5 of the protection structure 2.

The hooking element 16*a*, auxiliary hooking element 16*b* and connecting element 16*d* interact with each other to counteract and/or limit possible rotations around the longitudinal axis "X" of the delivery unit 9.

Operation of the apparatus for delivering hot air described above in detail mainly as regards structure is as follows.

When the user gets hold, from any position, of the delivery tube 9*c* pulling the latter so as to orientate the air blow being delivery towards his/her hair, the delivery unit 9*a* moves from the rest position to the operating position. During passage of the delivery unit 9 from the rest position to the operating position the engagement element 13 takes an inclined direction to the vertical causing disengagement of lug 13*c* from the contact element 15*a* of the control device 15. As a result of this, the contact element 15 shifts from the inserted position to the drawn-out position upon the action of the spring return means. When the contact element 15 reaches the draw-out position, it closes the power circuit so that the motor and the electric resistances present within the delivery unit 9 are power-supplied. Then the fan is driven in rotation generating an air flow from the inlet end 9*a* to the outlet end 9*b* and the electric resistances ensure heating of this flow The air flow goes on along the delivery tube 9*c* until it comes out of it.

When the user puts the delivery tube 9*c* back to the initial position or leaves the latter down so that it goes back to the rest position, the engagement means 13 takes a vertical position. During this movement, the lug 13*c* acts on the contact element 15*a* and in particular on its end 15*b*, from the peripheral region to the central region of same, pushing the contact element 15*a* to an inserted position. Under this situation, the contact element 15*a* opens the power circuit breaking current passage. Thus the fan-operating motor is shut off and, as result, the generated air flow is stopped.

The present invention solves the problems found in the known art and reaches the intended purposes.

Due to the presence of a ball joint made up of the engagement element 13 and the holding seating 12, the delivery unit 9 has a wide movement area enabling starting of same from any position. More particularly, the ball joint gives rise to a single rest position and an infinite number of operating positions. In detail, when the delivery unit 9 is at a rest position, the longitudinal axis "X" thereof is coincident with a vertical direction passing through the center of the active portion 13*b* of the engagement element 13, When it is necessary to start air delivery, the user's only action is pulling of the delivery tube 9*c* moving it from the rest position so that its longitudinal axis "X" is no longer coincident with the vertical direction. In other words, the above described starting system has no dead centers at which the delivery unit, in spite of its being pulled, is not operated.

Advantageously, the concerned apparatus lends itself to be also installed close to the ceiling of a room, to be used as a heating element for a room. Under this circumstance, the shelf-like portion 14 may be advantageously provided to be slidably guided in a substantially vertical direction with respect to the protection structure 2, and be movable downwardly against the action of spring return means (not shown) due to the weight of the flexible delivery tube 9. In this way, operation of the delivery unit 9 can be obtained leaving the flexible tube 9*c* in a downwardly-extended position in the extension of the outlet end 9*b*, so that its weight lies heavy on the shelf-like portion 14 and overcomes the action of the spring counter-means. Shutting off of apparatus 1 is automatically caused when the flexible tube 9*c* is linked at one final end thereof to the protection structure 2 or other fixed fastening point placed above, so that the effect of its weight on the shelf-shaped portion 14 is reduced and lifting of the latter is caused upon the action of the spring return means, which will bring about switching over of the control device 15.

One or more through slits 2*a* can be associated with the protection structure 2, preferably close to the upper region of the protection wall 6*a* and/or the side walls 7, to ensure air supply to the delivery unit 9. This expedient offers the advantage of increasing efficiency of apparatus 1 when the latter is installed close to the ceiling of a room, ensuring suction and consequent downward transferring of the hot air tending to accumulate close to the ceiling itself.

What is claimed is:

1. An apparatus for delivering hot air comprising:

a protection structure (2) to be fastened to a support structure (4);

at least one air-delivery unit (9) oscillatably linked to the protection structure (2) and movable between a rest position in which air delivery is shut off and an operating position at which air deliver is started;

at least one electric control device (15) operatively associated with the delivery unit (9) to start and/or shut off said unit at said operating position and rest position respectively, said apparatus further comprising coupling means (11) operatively interposed between the delivery unit (9) and the protection structure (2) to oscillatably engage the delivery unit around at least one first and one second rotation axes ("Y", "Z") which are perpendicular to each other.

2. The apparatus as claimed in claim 1, wherein the coupling means (11) comprises at least one ball joint operatively interposed between the protection structure (2) and the delivery unit (9).

3. The apparatus as claimed in claim 2, wherein said ball joint comprises:

at least one holding seating (12) formed in the protection structure (2) and showing a concave active surface (12*a*);

at least one engagement element (13) associated with the delivery unit (9) and having a substantially rounded active portion (13*b*) operating on the active surface (12*a*) of the holding seating (12) to ensure freedom of oscillation to the delivery unit (9) around said first and/or second rotation axes ("Y", "Z").

4. The apparatus as claimed in claim 3, wherein the holding seating (12) is formed at an end (14*a*) of a shelf-shaped portion (14) jutting out internally of the protection structure (2).

5. The apparatus as claimed in claim 3, wherein the active surface (12*a*) is shaped in the form of a spherical portion.

6. The apparatus as claimed in claim 3, wherein the engagement element (13) has at least one lug (13*c*) interacting with a contact element (15*a*) jutting out of the control device (15) to start and/or shut off air delivery, the lug (13*c*) pressing the contact element (15*a*) when the delivery unit (9) is at a rest position and disengaging the contact element (15*a*) when the delivery unit (9) is at an operating position.

7. The apparatus as claimed in claim 6, wherein the contact element (15*a*) has a substantially rounded end (15*b*) so that when the delivery unit moves from the operating position to the rest position, the lug (13*c*) presses the contact element (15*a*) acting upon the rounded end (15*b*) from the periphery towards the center.

8. The apparatus as claimed in claim 7, wherein the control device (15) is an electric switch intended to selectively open and close an electric power circuit of the delivery unit (9), when the contact element (15*a*) is pressed by, and when the contact element (15*a*) is disengaged from the lug (13*c*), respectively.

9. The apparatus as claimed in claim 3, wherein the engagement element (13) is substantially ball-shaped.

10. The apparatus as claimed in claim 3, wherein the engagement element (13) is associated with the delivery unit (9) through an elongated connecting portion (13*a*) passing through a through opening (12*b*) formed in the holding seating (12).

11. The apparatus as claimed in claim 1, further comprising locking means (16) to inhibit rotations of the delivery unit (9) around a longitudinal axis ("X") thereof.

12. The apparatus as claimed in claim 11, wherein the locking means (16) comprises:

at least one hooking element (16*a*) associated with said protection structure (2);

at least one auxiliary hooking element (16*b*) associated with said delivery unit (9);

at least one connecting element (16*d*) operatively interposed between said hooking element (16*a*) and auxiliary hocking element (16*b*) and engaging these hooking elements (16*a*, 16*b*) at the respective ends (16*c*) thereof.

13. The apparatus as claimed in claim 1, wherein said coupling means (11) further secures the delivery unit (9) to the protection structure (2) in a slidable manner along a substantially vertical direction, spring return means being provided to exert an upwardly-directed thrust on the delivery unit.

14. The apparatus as claimed in claim 1, wherein said protection structure (2) has slits (2*a*) at the upper part thereof, for air supply.

* * * * *

UNITED STATES PATENT AND TRADEMARK OFFICE

CERTIFICATE OF CORRECTION

PATENT NO. : 6,521,850 B2 
DATED : February 18, 2003
INVENTOR(S) : Carlo Bertani It is certified that error appears in the above-identified patent and that said Letters Patent is hereby corrected as shown below:

Title page,
Item [73], Assignee, should read as follows:

-- MO-EL S.R.L. Reggio Emilia (IT) --

Signed and Sealed this

Eleventh Day of November, 2003

JAMES E. ROGAN
*Director of the United States Patent and Trademark Office*